US009751648B2

(12) United States Patent
Polloni et al.

(10) Patent No.: US 9,751,648 B2
(45) Date of Patent: Sep. 5, 2017

(54) EMBOSSING DEVICE AND PACKAGING MACHINE COMPRISING THE DEVICE

(71) Applicant: G.D S.p.A., Bologna (IT)

(72) Inventors: Roberto Polloni, Modigliana (IT); Marco Ghini, Monte San Pietro (IT); Stefano Negrini, Calderara di Reno (IT)

(73) Assignee: G.D. S.P.A., Bologna (IT)

( * ) Notice: Subject to any disclaimer, the term of this patent is extended or adjusted under 35 U.S.C. 154(b) by 567 days.

(21) Appl. No.: 14/336,121

(22) Filed: Jul. 21, 2014

(65) Prior Publication Data

US 2015/0027083 A1 Jan. 29, 2015

(30) Foreign Application Priority Data

Jul. 23, 2013 (IT) ..... BO2013A0392

(51) Int. Cl.
*B65B 19/28* (2006.01)
*B65B 57/02* (2006.01)
(Continued)

(52) U.S. Cl.
CPC ..... *B65B 19/28* (2013.01); *B31F 1/07* (2013.01); *B65B 19/228* (2013.01); *B65B 57/02* (2013.01);
(Continued)

(58) Field of Classification Search
CPC ..... B65B 19/28; B65B 19/228; B65B 57/02; B65B 61/02; B65B 61/06; B31F 1/07;
(Continued)

(56) References Cited

U.S. PATENT DOCUMENTS 5,715,658 A * 2/1998 Citron ..... G07F 9/06 414/411
5,865,014 A * 2/1999 Citron ..... G07F 9/06 414/412
(Continued)

FOREIGN PATENT DOCUMENTS

DE 102008013322 A1 10/2008
EP 1867470 A1 12/2007
(Continued)

OTHER PUBLICATIONS

Italian Search Report dated Apr. 30, 2014 from counterpart application No. B020130392.

*Primary Examiner* — Hemant M Desai
*Assistant Examiner* — Lucas Palmer
(74) *Attorney, Agent, or Firm* — Shuttleworth & Ingersoll, PLC; Timothy Klima

(57) ABSTRACT

An embossing device comprises a first embossing roller and a second embossing roller forming a passage for a web of wrapping material to be embossed, which has a main line of extension and a direction of feed; the first embossing roller comprises on its outer surface toothings to make an imprint on the web; a first toothing having a first impression to imprint on said web a first segment of a reference for identifying a section of the web and a second toothing to imprint a decorative pattern on the web; the second toothing comprises a zone without teeth for defining on the web a second, unembossed segment of the reference; the first toothing and the zone without teeth are offset from each other along a directrix of the first roller.

12 Claims, 2 Drawing Sheets

(51) Int. Cl.

| | |
|---|---|
| ***B65B 61/02*** | (2006.01) |
| ***B65B 61/06*** | (2006.01) |
| ***B31F 1/07*** | (2006.01) |
| ***B65B 19/22*** | (2006.01) |

(52) U.S. Cl.
CPC ..... *B65B 61/02* (2013.01); *B65B 61/06* (2013.01); *B31F 2201/0733* (2013.01); *B31F 2201/0779* (2013.01); *B31F 2201/0794* (2013.01)

(58) Field of Classification Search
CPC ..... B31F 2201/0733; B31F 2201/0779; B31F 2201/0794
USPC ..... 493/59, 64, 66, 79, 144, 160
See application file for complete search history.

(56) References Cited

U.S. PATENT DOCUMENTS 6,155,025 A * 12/2000 Komiya ..... B65B 5/10 53/147
6,317,648 B1 * 11/2001 Sleep ..... B65B 5/103 53/500
7,765,776 B1 * 8/2010 Leu ..... B65B 5/045 53/131.4
7,779,614 B1 * 8/2010 McGonagle ..... A61J 1/035 53/238
7,814,731 B2 * 10/2010 Bender ..... B65B 3/003 53/276
7,900,658 B2 * 3/2011 Osborne ..... A61J 1/20 141/104
8,037,659 B2 * 10/2011 Osborne ..... A61J 1/2096 250/577
8,141,330 B2 * 3/2012 Henkel ..... B65B 5/103 53/237
8,413,575 B2 4/2013 Schaum et al.
8,474,228 B2 * 7/2013 Adair ..... B01L 9/06 53/158
8,943,785 B2 * 2/2015 Blickhan ..... G06Q 10/06 53/167
2001/0022064 A1 * 9/2001 Hidding ..... B43M 3/045 53/460
2002/0026768 A1 * 3/2002 Duncan ..... B65B 25/008 53/52
2003/0115835 A1 * 6/2003 Kadota ..... B65B 25/146 53/410
2003/0188511 A1 * 10/2003 Iwamura ..... B65B 5/024 53/410
2004/0123564 A1 * 7/2004 McErlean ..... B65B 5/103 53/411
2005/0198920 A1 * 9/2005 Nakagawa ..... B65B 9/00 53/64
2008/0053040 A1 * 3/2008 Petersen ..... H05K 1/0266 53/396
2008/0115465 A1 * 5/2008 Dickinson ..... A45C 13/021 53/476
2010/0018154 A1 * 1/2010 Laperche ..... B07C 5/342 53/53
2011/0308206 A1 * 12/2011 Beckel ..... B65B 39/005 53/475
2012/0151877 A1 * 6/2012 Stamm Kristensen ..... A23N 17/007 53/411
2012/0324828 A1 * 12/2012 Yasunaga ..... B08B 7/02 53/111 R
2013/0097975 A1 * 4/2013 Bailey ..... B65G 47/28 53/473
2013/0273322 A1 10/2013 Boegli
2013/0340390 A1 * 12/2013 Carson ..... B25J 9/0096 53/411
2014/0059977 A1 3/2014 Boegli
2014/0069838 A1 * 3/2014 Minvielle ..... B65D 85/00 206/459.5
2014/0157731 A1 * 6/2014 Perazzo ..... B65B 57/02 53/473
2015/0102100 A1 * 4/2015 Hattrup ..... G06Q 50/28 235/375
2015/0272824 A1 * 10/2015 Jaynes ..... B65B 57/02 206/534
2016/0001003 A1 * 1/2016 Perazzo ..... B65B 7/2807 53/493

FOREIGN PATENT DOCUMENTS

EP 2468493 A1 6/2012
EP 2511088 A1 10/2012
WO 2008134910 A1 11/2008

* cited by examiner

EMBOSSING DEVICE AND PACKAGING MACHINE COMPRISING THE DEVICE

This application claims priority to Italian Patent Application BO2013A000392 filed Jul. 23, 2013, the entirety of which is incorporated by reference herein.

BACKGROUND OF THE INVENTION

This invention relates to an embossing device and, more specifically, to an embossing device intended for a machine of the tobacco industry, preferably a packaging machine.

The invention also relates to a method for identifying a web of wrapping material in a packaging machine.

A packaging machine designed to make packets filled with tobacco products, such as cigarettes, for example, to which express is made herein without limiting the scope of the invention, comprises an embossing device.

The embossing device embosses a web of wrapping material, usually foil paper or the like, which, after being cut into lengths, is fed to the wrapping system of the cigarette packaging machine.

As is known, in packaging machines of this kind, the web of foil paper is fed by means of an unwinding system along a predetermined path up to a cutting system which divides it along a cutting line transversal to a direction of web feed into individual lengths, each used to wrap a group of cigarettes to form an inner wrapper of a respective packet.

As mentioned, the web upstream of the cutting system is subjected to the action of the embossing device which basically comprises two counter-rotating rollers, a matrix roller and an opposing roller, located on opposite sides of the aforementioned path and tangent to each other.

On their respective cylindrical surfaces, these rollers are provided with protrusions, for example frusto-pyramidal in shape, which give the web passing through it its typical rough-textured surface.

Generally speaking, the cylindrical surfaces of the embossing rollers may also have zones without the frusto-pyramidal protrusions or with protrusions having other shapes, to produce desired graphic patterns or text on each length of web and hence on a portion of the inner wrapper of the cigarette packet.

In order to position the graphic patterns relative to the group of cigarettes, the embossing device is usually shaped to imprint on each length of web a reference mark or centering mark used to synchronize the cutting system with the unwinding of the web.

More specifically, the centering mark, usually also made by embossing, allows both the unwinding system and the cutting system to be synchronized based on the pattern to be imprinted on the web.

The packaging machine comprises a system for reading the mark in order to identify a predetermined section of the web.

The cutting system and the web unwinding system are controlled according to the recognition of that section.

The prior art solutions have some disadvantages.

In the case of uniform embossing, the reference mark consists, for example, of a rectangle which is not embossed.

With other types of background embossing and/or web material, however, it is necessary to optimize the contrast between the reference mark and the background in order to allow it to detected by the optical reading system.

The centering mark may be, for example, in the form of a uniformly embossed rectangle on a non-embossed web or a non-embossed rectangle inside a uniformly embossed frame.

In order to identify and choose the type of mark most easily detected by the optical system, packaging machine constructors have to carry out a number of tests.

Before being able to determine the reference mark specifications, these tests require the construction or purchase of embossers with different patterns and reference marks, a set of measurements and tests and calibration of the optical system.

SUMMARY OF THE INVENTION

In this context, the main technical purpose of this invention is to provide an embossing device and a packaging machine which are free of the above mentioned drawbacks.

The aim of this invention is to provide an embossing device which more effectively makes a centering reference in the web of wrapping material being processed.

A further aim of this invention is to provide a packaging machine that is more versatile than prior art machines.

A yet further aim of the invention is to provide a method for identifying a reference on a continuous web and which can be implemented better than prior art solutions.

The technical purpose and aims specified are substantially achieved by an identification method and a packaging machine according to present disclosure.

BRIEF DESCRIPTION OF THE DRAWINGS

Further features of the invention and its advantages are more apparent in the non-limiting description below, with reference to a preferred but non-exclusive embodiment of a packaging machine, as illustrated in the accompanying drawings, in which.

DESCRIPTION OF THE PREFERRED EMBODIMENTS

Figure 1:
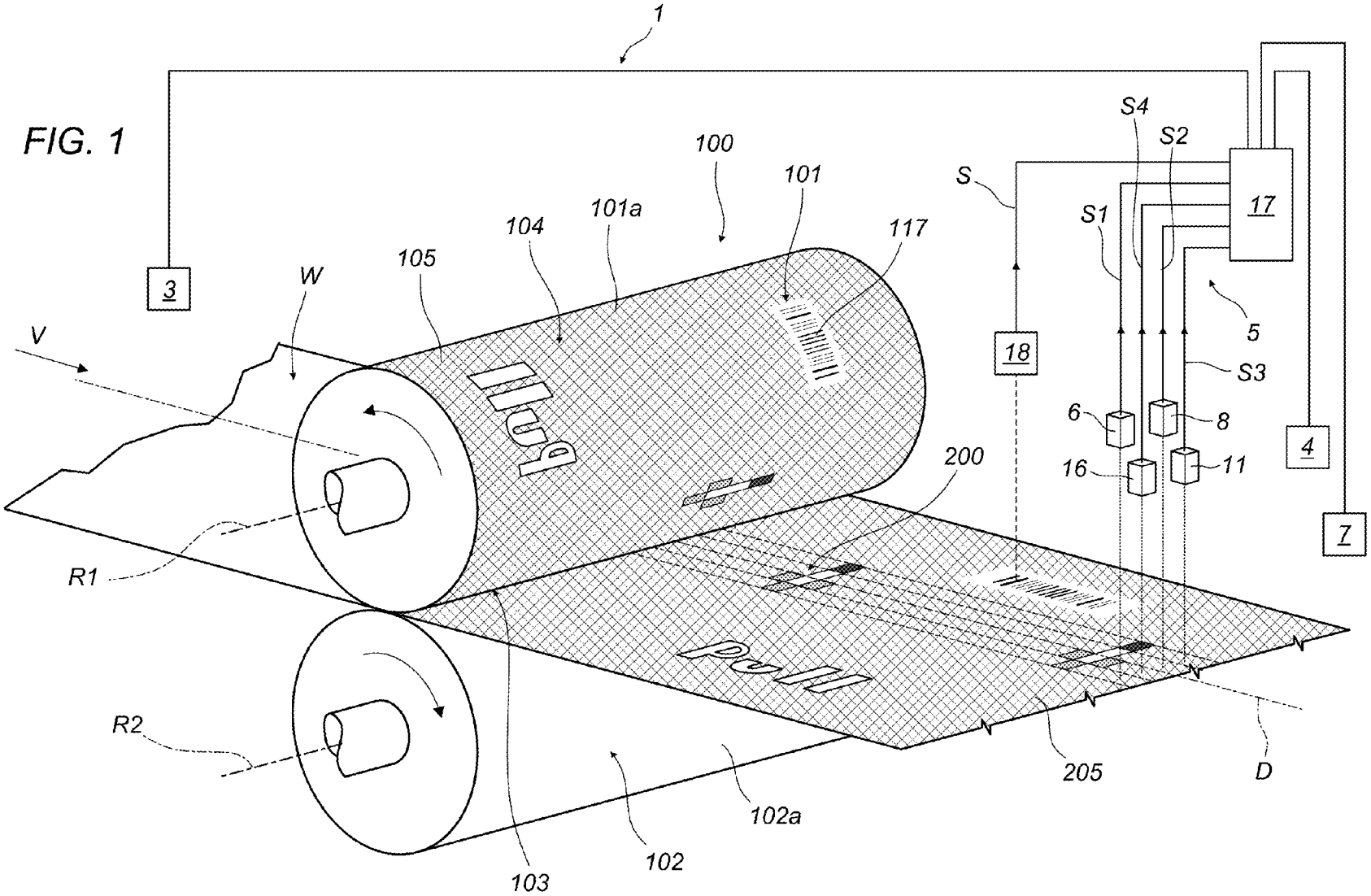
FIG. 1 illustrates a packaging machine according to this invention in a schematic perspective view, partly in blocks and with some parts cut away for greater clarity.

With reference to FIG. 1, the numeral 1 denotes a packaging machine according to this invention.

The machine 1 is hereinafter described only insofar as necessary for understanding this invention.

The machine 1 is designed to make packets, not illustrated, containing tobacco products such as cigarettes, for example.

The machine 1 comprises forming means, of substantially known type and not described, for forming a wrapper for the tobacco products from a web W of wrapping material.

More specifically, the wrapper is the inner wrapper of a packet and the web W of wrapping material is, for example, a web of paper material or metallized paper, known as foil paper, or of metallic material such as, for example, aluminum foil or the like.

The web W has a line of main extension D and advances in a feed direction V.

The forming means basically comprise a system for unwinding the web W, schematically represented as a block 3, a system for cutting the web into lengths, schematically represented as a block 4, and a system for folding the lengths of wrapping material, schematically represented as a block 7.

The machine 1 comprises a synchronizing system, denoted by the reference numeral 5, for synchronizing the unwinding system 3, the cutting system 4 and the folding system 7.

As will become clearer as this description continues, the synchronizing system 5 is configured to identify a section of the web W based on the detection on the web W itself of a reference 200 associated with that section, that is to say, a reference 200 which defines a section of the web which controls the drive mechanism of the cutting system 4.

More specifically, the synchronizing system 5 identifies a predetermined section of the web W, for example a transversal section thereof, based on the contrast between the reference 200 and the web W.

The forming means comprise an embossing device 100 located along the feed path of the web W to imprint a permanent mark on the web W of wrapping material.

The device 100 is of a substantially known type and is described only insofar as necessary for understanding this invention.

The device 100 comprises a first embossing roller 101 and a second embossing roller 102 having respective axes of rotation R1 and R2.

In the embodiment illustrated, with reference in particular to FIG. 1, it may be observed that the roller 101 rotates anticlockwise and the roller 102 clockwise.

The roller 101 and the roller 102 are substantially cylindrical and the axes R1 and R2 are preferably parallel.

The roller 101 and the roller 102 delimit a passage 103 for the web W and are positioned relative to each other in substantially known manner to emboss the web W as it passes between the rollers 101 and 102 in the passage 103.

In one embodiment, the roller 101 comprises on its outer surface 101*a*, imprinting means 104 operating on the web W.

The imprinting means 104, as will become clearer as this description continues, are structured to imprint the reference 200 on the web W.

In one embodiment, the imprinting means 104 are structured to imprint a decorative pattern 205 on the web W.

The term "decorative pattern" 205 is used in this invention to mean any finish, design, text or the like which must appear on the inner wrapper of the cigarette packet.

In the example illustrated, the decorative pattern 205 comprises a rough-textured finish of the web W and the word "Pull" typically appearing on the inner wrappers of cigarette packets.

In the embodiment illustrated, the roller 102 is an opposing roller acting in conjunction in substantially known manner with the roller 101 by means of its cylindrical surface 102*a*.

In an embodiment not illustrated in detail and known as pin up-pin up configuration, the surface 101*a* comprises a plurality of imprinting teeth and the surface 102*a* comprises a plurality of imprinting teeth acting in conjunction with the imprinting teeth on the surface 101*a*.

The teeth on the two surfaces 101*a* and 102*a* act in conjunction with each other, for example to satinize the web W of wrapping material, and the teeth have, for example, a pyramid shape.

In an embodiment not illustrated in detail and known as pin up-pin down configuration, the surface 101*a* comprises a plurality of imprinting teeth and the surface 102*a* comprises a plurality of recesses for receiving the teeth of the roller 101.

As mentioned, the imprinting means 104 are structured to imprint the reference 200 on the web.

Figure 2:
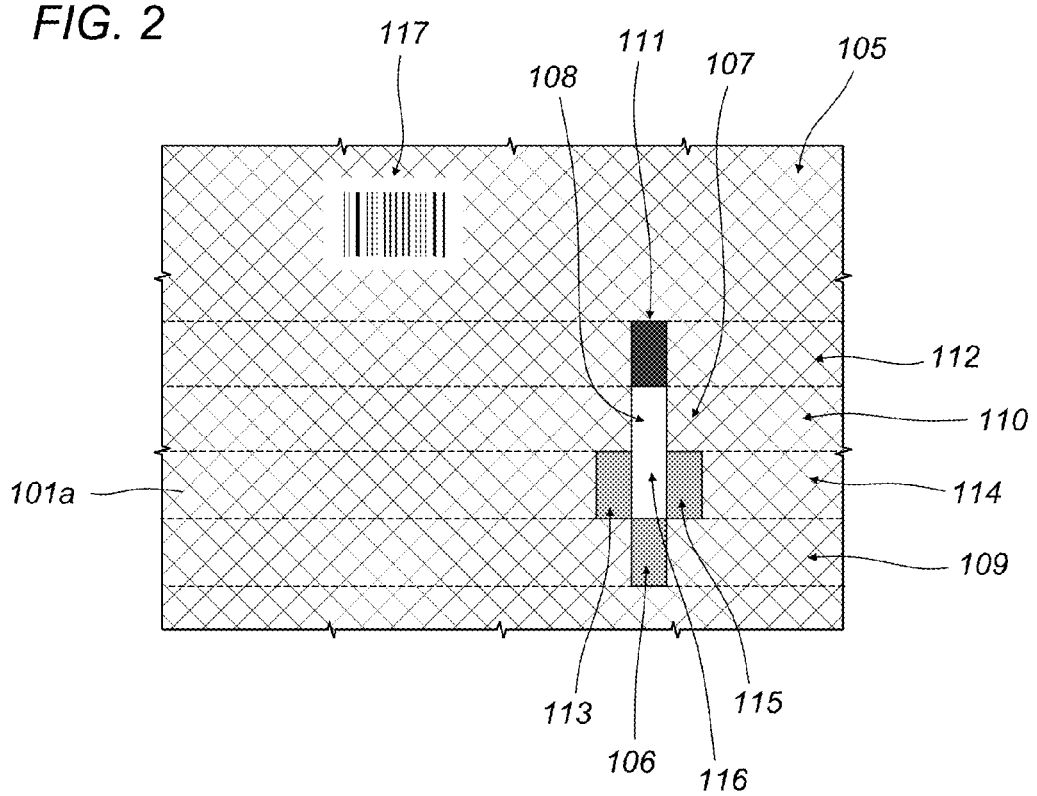
FIG. 2 illustrates a portion of the embossing roller forming part of the machine of FIG. 1, in a schematic plan view from above.
Figure 3:
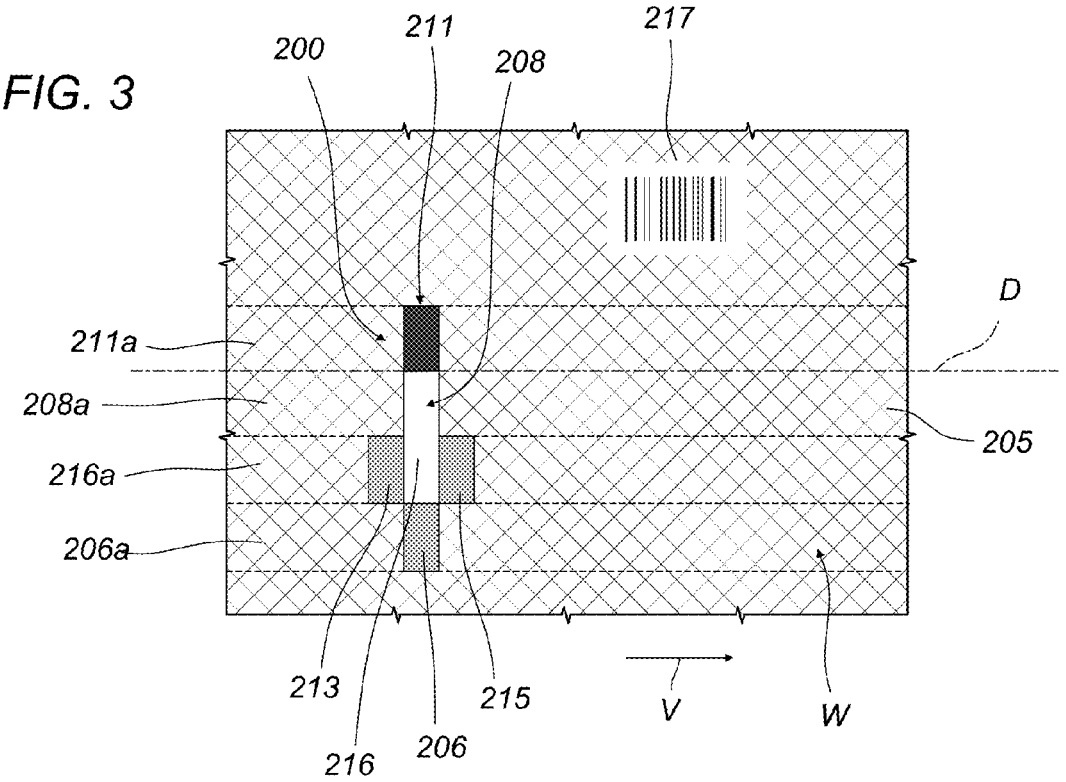
FIG. 3 illustrates a portion of the web of wrapping material processed in the machine of FIG. 1, in a schematic plan view from above.

With reference to FIGS. 2 and 3, in one embodiment, the imprinting means 104 comprise a first toothing 106 having a first impression to imprint on said web W a first segment 206 of the reference 200 according to a first pattern.

Preferably, in one embodiment, the first segment 206 of the reference 200 is embossed on the web W.

In one embodiment, the means 104 comprise a second toothing 105 having a second impression to imprint the above mentioned decorative pattern 205 on the web.

The second toothing 105 comprises a zone 108 without teeth for defining on the web W a second, unembossed segment 208 of the reference 200.

Preferably, the zone 108 extends parallel to the axis R1 of the roller 101 and is made on the surface 101*a* of the roller 101 itself.

In practice, when the web W passes through the passage 103, the zone 108 does not impress any pattern on it, leaving the web W substantially smooth.

As schematically illustrated, downstream of the device 100, the web W has imprinted on it the decorative pattern 205 whereas the segment 208 is smooth, creating a contrast against the decorative pattern 205.

As illustrated, the first toothing 106 and the zone 108 without teeth are offset from each other along a directrix of the first roller 101.

In other words, the first toothing 106 and the zone 108 lie on distinct directrices of the roller 101.

More specifically, the first toothing 106 is located in such a way that the full length of it, measured along a generatrix of the roller 101, lies on a first band 109 of directrices of the roller 101.

More specifically, the full length of the zone 108, measured along a generatrix of the roller 101, lies on a second band 110 of directrices of the roller 101.

Preferably, the band 109 and the band 110 do not have any directrices of the roller 101 in common.

With reference in particular to FIG. 2, it may be observed that the imprinting means 104 comprise a third toothing 111 having a third impression, preferably different to the impression of the toothing 106, to imprint on the web W a third segment 211 of the reference 200 according to a second pattern, different to the above mentioned first pattern.

Preferably, in one embodiment, the third segment 211 of the reference 200 is, in effect, embossed on the web W.

The first toothing 106, the zone 108 without teeth and the third toothing 111 are offset from each other along a directrix of the roller 101.

More specifically, the full length of the zone 111, measured along a generatrix of the roller 101, lies on a third band 112 of directrices of the roller 101.

The band 109, the band 110 and the band 112 do not have any directrices of the roller 101 in common.

In a preferred embodiment, the imprinting means 104 comprise a fourth toothing 113 having a fourth impression, different to the impression of the toothing 106 and to the impression of the toothing 111 to imprint an embossed segment 213 on the web W.

The first toothing 106, the zone 108 without teeth, the third toothing 111 and the fourth toothing 113 are offset from each other along a directrix of the roller 101.

More specifically, the full length of the zone 113, measured along a generatrix of the roller 101, lies on a fourth band 114 of directrices of the roller 101.

The band 109, the band 110, the band 112 and the band 114 do not have any directrices of the roller 101 in common.

The imprinting means 104 comprise a fifth toothing 115 having a fifth impression, preferably the same as the impression of the toothing 113, to imprint an embossed segment 215 on the web W.

The full length of the zone 115, measured along a generatrix of the roller 101, lies on the band 114 of directrices of the roller 101.

The toothing 113 and the toothing 115 are spaced from each other along a directrix of the band 114 in such a way as to delimit a zone 116 without teeth on the roller 101.

The zone 116 lies in the band 114 and is aligned along a generatrix of the roller 101 with the toothings 106 and 111 and with the zone 108.

The zone 116 defines on the web W a fourth, unembossed segment 216, of the reference 200.

In light of the above, in one embodiment, the reference 200 comprises the segment 206, the segment 208, the segment 211 and the segment 216 which are offset from each other along the main line of extension D.

More specifically, each segment 206, 208, 211, 216 of the reference 200 identifies a corresponding strip 206*a*, 208*a*, 211*a*, 216*a* on the web W.

Each strip 206*a*, 208*a*, 211*a*, 216*a* extends along the line D.

Preferably, the segment 206, the segment 208, the segment 211 and the segment 216 are aligned along a section of the web W at right angles to the line D.

In one embodiment, the imprinting means 104 comprise a sixth toothing 117 to imprint on said web W a code 217 which identifies the embossing device 100.

In one embodiment, the machine 1 comprises a reading sensor for each strip of the web W where there is a segment of the reference 200.

In the example illustrated in FIG. 1, the machine 1 comprises a sensor 6 for reading the strip 206*a*, a sensor 8 for reading the strip 208*a*, a sensor 11 for reading the strip 211*a* and a sensor 16 for reading the strip 216*a*.

The first reading sensor 6 is configured to generate a first reading signal S1 depending on the reading contrast between the first segment 206 of the reference 200 and the web W.

The contrast between the first segment 206 and the web W is read substantially as a step up or a step down depending on the pattern 205, if present, imprinted on the web W.

The second reading sensor 8 is configured to generate a second reading signal S2 depending on the reading contrast between the second segment 208 of the reference 200 and the web W.

The contrast between the second segment 208 and the web W is read, for example, substantially as a step up or a step down depending on the pattern 205, if present, imprinted on the web W.

The third reading sensor 11 is configured to generate a third reading signal S3 depending on the reading contrast between the third segment 211 of the reference 200 and the web W.

The contrast between the third segment 211 and the web W is read, for example, substantially as a step up or a step down depending on the pattern 205, if present, imprinted on the web W.

The fourth reading sensor 16 is configured to generate a fourth reading signal S4 depending on the reading contrast between the fourth segment 216 of the reference 200 and the segment 213 and/or the segment 215.

In the example illustrated, the segment 215 is upstream of the segment 216 along the web feed direction V and the segment 213 is downstream of the segment 216 along the web feed direction V.

The contrast between the fourth segment 216 and the segment 213 and/or 216 is read, for example, substantially as a step up or a step down.

For convenience of description, reference is made below, also for the segment 216, to the contrast between the same and the web W and not to the contrast between it and the adjacent embossed segments 213, 215, it being understood that the contrast between the segment 216 and the segment 213 and/or 215 is implied.

The value of each of the aforementioned steps depends on the reading contrast for reading the respective segment of the reference 200.

The machine 1, and more specifically, the aforementioned synchronizing system 5, comprises a computerized control unit 17 in communication with the sensors 6, 8, 11, 16.

The computerized control unit 17 is configured to receive the signal S1, S2, S3, S4 and to identify the section of the web W based on the signal S1, or on the signal S2, or on the signal S3 or on the signal S4 depending on the reading contrast between the respective segment 206, 208, 211, 216 of the reference 200 and the web W.

Advantageously, the unit 17 is configured to learn, in a learning step, which segment of the reference 200 has the highest reading contrast for the web W being processed and the pattern 205 imprinted thereon, and to base subsequent selections on the segment with the highest contrast.

Advantageously, a device 100 as described above can be used to obtain a reference 200 comprising a plurality of segments 206, 208, 211, 216, each readable independently of the others.

By suitably selecting the patterns of the embossed segments of the reference 200 and considering the presence of the unembossed segments, the reference 200 comprises at least one segment that will certainly be read, irrespective of the pattern on the web W.

In other words, given the reference 200 composed of a plurality of segments having patterns which differ from each other and, thus, different contrasts against the web W, the computerized control unit 17 always has available a signal S1 or S2 or S3 or S4 which is determined by a contrast between the respective segment and the web W and which is sufficiently clear to precisely identify the web section allowing the cutting system to be synchronized.

In alternative embodiments, the embossing device 100 comprises a plurality of toothings to imprint segments of the reference 200 which have different patterns in order to obtain a plurality of contrasts against the web W.

In one embodiment, the reference 200 does not comprise segments which are substantially smooth, that is to say, it comprises only embossed segments obtained, for example, by means of toothings such as the toothing 111 or 106.

In practice, the reference 200 constitutes a universal reference which can be used in all embossing rollers and which always allows obtaining a reference mark that can be interpreted with relative certainty for any web W, irrespective of the material or of the pattern imprinted thereon.

In one embodiment, the computerized control unit 17 is configured to generate a difference signal between the first and second reading signals S1, S2 and to identify the section based on that difference signal.

In practice, for example, reading the segment 206 and the segment 208 generates the signals S1 and S2 which relate to an embossed segment and a smooth segment.

The difference between these two signals simulates a reading with the highest contrast as if it were a reference 200 defined by an embossed segment on a smooth, unembossed band or strip.

In one embodiment, the machine 1, and more specifically, the synchronizing system 5, comprises a sensor 18 for identifying the roller 101 and in communication with the computerized control unit 17.

The sensor 18 is configured to read the aforementioned identification code 217 and to generate a signal S identifying the embossing device 100.

The computerized control unit 17 is configured to identify the section and to synchronize the cutting system 4 with the unwinding system 3 based on the signal S1 or the signal S2 or the signal S3 or the signal S4 depending on the identification signal S.

Once the embossing device 100 mounted on the machine 1 has been recognized, that is to say, when the pattern imprinted on the web W has been recognized based on the signal S, the computerized control unit 17 is configured to select the signal S1 or S2 or S3 or S4 produced by the best reading contrast.

In practice, reading the code 217 allows the computerized control unit 17 to learn which of the signals S1, S2, S3, S4 is the one produced by the best reading contrast and to select that signal to identify the section of the web W on the basis of which to drive, in particular, at least the system 3 for unwinding the web W, the cutting system 4 and the folding system 7.

In use, a method for identifying a section of the continuous web W comprises a step of defining on the web W, by means of embossing, a reference 200 associated with that section so that identifying the reference 200 also identifies the section of the web W concerned.

The method comprises a step of reading the reference 200 which, as mentioned, comprises for example, segments 106, 108, 111, 116 which have different contrasts relative to the web W.

The reference segments are offset from each other along the line D so that they can be read independently of each other.

In one embodiment, the reference 200 comprises the unembossed segment 116 located inside a sort of frame defined by the embossed segments 113, 115 to produce further contrast against the web W.

In one embodiment, as mentioned, the step of reading the reference 200 comprises reading all the segments of the reference 200 by means of the respective reading sensors 6, 8, 11, 16 and a step of selecting from the separate signals S1, S2, S3, S4 generated by the sensors, the reading signal which expresses the highest reading contrast to identify that section.

In one embodiment, the code 217 is imprinted during the step of embossing the web W and the step of reading the reference 200 comprises a step of reading the code and all the segments of the reference.

As mentioned, the method comprises selecting from all the signals generated by the reading of the reference segments, the one corresponding to the best contrast based on the code of the device 100.

In one embodiment, the method comprises identifying the reference segment expected to provide the best contrast against the web and positioning a reading sensor at that segment.

In one embodiment, the method comprises identifying the reference segment expected to provide the best contrast against the web and, after positioning all the reading sensors to read all the segments, using only the sensor at the segment identified.

What is claimed is:

1. A method for identification of a section of a continuous web having a main line of extension and movable in a direction of feed according to a predetermined path, comprising:

a step of definition on said web of a reference associated with said section, a step of reading said reference to identify said section using a contrast between said reference and said web, wherein said step of definition of the reference comprises a step of embossing said web using an embossing device, said reference comprising at least an embossed first segment and an unembossed second segment, said first segment having a contrast compared with said web which is different to the contrast of said second segment compared with said web, said first and second segments being positioned on said web along respective strips parallel with said main line of extension, said method comprising a step of reading the segment of the reference out of said first and second segments which has greatest reading contrast, said section being identified based on the segment having the greatest reading contrasts;

wherein said embossing device comprises a first embossing roller and a second embossing roller forming a passage for a web to be embossed, said first embossing roller and said second embossing roller being relatively positioned for embossing the web passing through the passage, wherein at least said first embossing roller comprises on its outer surface, an imprinting device for imprinting the reference on the web, the imprinting device comprising a first toothing having a first impression and at least a second toothing having a second impression different from the first impression, the second toothing comprising a zone without teeth; and wherein said embossing step comprises imprinting said first segment by said first toothing according to a first pattern, imprinting a decorative pattern by said second toothing and defining said second segment by the zone without teeth.

2. The method according to claim 1, wherein said reference comprises at least an embossed third segment, obtained in said embossing step, said third segment having a contrast compared with said web which is different to the contrast of the first and second segments compared with said web, said first, second and third segments being positioned on the web respectively along a first, a second and a third strip each parallel with the main line of extension.

3. The method according to claim 2, wherein said reference comprises an unembossed fourth segment positioned on said web along a respective fourth strip parallel with said main line of extension, said reference comprising an embossed fifth segment aligned with said fourth segment according to said main line of extension and positioned downstream of said fourth segment according to said direction of feed, said reference comprising an embossed sixth segment aligned with said fourth segment according to said main line of extension and positioned upstream of said fourth segment according to said direction of feed, said fifth and sixth segments being obtained in said embossing step.

4. The method according to claim 3, wherein said step of reading said reference comprises reading all of the segments of said reference using a sensor for reading each segment, the reading of said first segment generating a first reading signal, the reading of said second segment generating a second reading signal, the reading of said third segment generating a third reading signal, the reading of said fourth segment generating a fourth reading signal, each reading signal being generated depending on the reading contrast of the respective segment of the reference, said method comprising a step of selection from said first, second, third and fourth reading signals of the reading signal expressing the greatest reading contrast for identifying said section.

5. The method according to claim 3, wherein said step of embossing said web comprises imprinting on said web a code for identifying said embossing device, said step of reading said reference comprising reading of said identification code using an identification sensor and all of the segments of said reference using a reading sensor for each segment, the reading of said identification code generating an identification signal for said embossing device, the reading of said first segment generating a first reading signal, the reading of said second segment generating a second reading signal, the reading of said third segment generating a third reading signal, the reading of said fourth segment generating a fourth reading signal, each reading signal being generated depending on the reading contrast of the respective segment of the reference, said method comprising a step of selection, to identify said section, of the first reading signal or of the second reading signal or of the third reading signal or of the fourth reading signal depending on said embossing device identification signal.

6. The method according to claim 3, wherein said step of reading said reference comprises selection of the segment amongst said first segment, said second segment, said third segment or said fourth segment of said reference having the greatest reading contrast compared with the web relative to the others, positioning a reading sensor for reading the selected segment, identifying said section based on the reading of the selected segment.

7. The method according to claim 2, wherein said reference comprises an unembossed fourth segment positioned on said web along a respective fourth strip parallel with said main line of extension and wherein said step of reading said reference comprises reading all of the segments of said reference using a sensor for reading each segment, the reading of said first segment generating a first reading signal, the reading of said second segment generating a second reading signal, the reading of said third segment generating a third reading signal, the reading of said fourth segment generating a fourth reading signal, each reading signal being generated depending on the reading contrast of the respective segment of the reference, said method comprising a step of selection from said first, second, third and fourth reading signals of the reading signal expressing the greatest reading contrast for identifying said section.

8. The method according to claim 2, wherein said reference comprises an unembossed fourth segment positioned on said web along a respective fourth strip parallel with said main line of extension and wherein said step of embossing said web comprises imprinting on said web a code for identifying said embossing device, said step of reading said reference comprising reading of said identification code using an identification sensor and all of the segments of said reference using a reading sensor for each segment, the reading of said identification code generating an identification signal for said embossing device, the reading of said first segment generating a first reading signal, the reading of said second segment generating a second reading signal, the reading of said third segment generating a third reading signal, the reading of said fourth segment generating a fourth reading signal, each reading signal being generated depending on the reading contrast of the respective segment of the reference, said method comprising a step of selection, to identify said section, of the first reading signal or of the second reading signal or of the third reading signal or of the fourth reading signal depending on said embossing device identification signal.

9. The method according to claim 2, wherein said reference comprises an unembossed fourth segment positioned on said web along a respective fourth strip parallel with said main line of extension and wherein said step of reading said reference comprises selection of the segment amongst said first segment, said second segment, said third segment or said fourth segment of said reference having the greatest reading contrast compared with the web relative to the others, positioning a reading sensor for reading the selected segment, identifying said section based on the reading of the selected segment.

10. The method according to claim 1, wherein at least said first segment and said second segment are aligned according to a reference line orthogonal relative to said main line of extension.

11. The method according to claim 1, wherein said reference is defined on said web together with said decorative pattern.

12. The method according to claim 1, wherein said reference comprises an unembossed fourth segment positioned on said web along a respective fourth strip parallel with said main line of extension, said reference comprising an embossed fifth segment aligned with said fourth segment according to said main line of extension and positioned downstream of said fourth segment according to said direction of feed, said reference comprising an embossed sixth segment aligned with said fourth segment according to said main line of extension and positioned upstream of said fourth segment according to said direction of feed, said fifth and sixth segments being obtained in said embossing step.

* * * * *